US009202643B2

(12) United States Patent
Belin

(10) Patent No.: US 9,202,643 B2
(45) Date of Patent: Dec. 1, 2015

(54) POLE OPERATING DEVICE IN A MEDIUM-VOLTAGE ELECTRIC CONTROL APPARATUS

(71) Applicant: Schneider Electric Industries SAS, Rueil-Malmaison (FR)

(72) Inventor: Yves Belin, Herbeys (FR)

(73) Assignee: Schneider Electric Industries SAS, Rueil-Malmaison (FR)

( * ) Notice: Subject to any disclaimer, the term of this patent is extended or adjusted under 35 U.S.C. 154(b) by 275 days.

(21) Appl. No.: 13/693,471

(22) Filed: Dec. 4, 2012

(65) Prior Publication Data

US 2013/0186231 A1 Jul. 25, 2013

(30) Foreign Application Priority Data

Dec. 8, 2011 (FR) ..... 11 03759

(51) Int. Cl.
*H01H 3/60* (2006.01)
*H01H 33/666* (2006.01)
*H01H 3/30* (2006.01)

(52) U.S. Cl.
CPC ..... *H01H 3/60* (2013.01); *H01H 3/3015* (2013.01); *H01H 33/666* (2013.01); *Y10T 74/2102* (2015.01)

(58) Field of Classification Search
CPC ..... H01H 3/30; H01H 3/3015; H01H 33/666
USPC ..... 200/400, 401, 318–325; 218/154
See application file for complete search history.

(56) References Cited

U.S. PATENT DOCUMENTS

| | | | | |
|---|---|---|---|---|
| 3,209,101 | A | 9/1965 | Peek et al. | |
| 5,140,117 | A | 8/1992 | Vianson | |
| 6,072,136 | A * | 6/2000 | Wehrli et al. | 200/401 |
| 6,160,234 | A * | 12/2000 | Wehrli et al. | 200/400 |
| 6,437,269 | B1 | 8/2002 | Rakus | |
| 8,058,580 | B2 * | 11/2011 | Gottschalk et al. | 200/400 |

* cited by examiner

*Primary Examiner* — Amy Cohen Johnson
*Assistant Examiner* — Marina Fishman
(74) *Attorney, Agent, or Firm* — Steptoe & Johnson LLP

(57) ABSTRACT

The present invention relates to a device D for controlling the poles of an electric protective apparatus capable of driving a shaft (1), called the first shaft, for supporting the movable contacts between an open position of the pole in which the movable contacts and the fixed contacts of the apparatus are separated and a closed position of the pole in which these movable and fixed contacts are closed, the said device D comprising a closure spring (2) controlled by an operating shaft (3), called the second shaft, the said spring (2) being capable of transmitting closure energy to the said shaft called the first shaft (1) after compression and passing of the said spring (2) beyond a neutral point line of passage, by means of a cam (8) rotated by the said shaft called the second shaft (3), and interacting with a roller (5) secured to the shaft called the first shaft (1), means (13) for holding the control shaft called the first shaft in the closed position, and means (18, 5) for unlocking the aforementioned holding means (13) allowing the rapid opening of the contacts of the apparatus, this device being characterized in that the aforementioned holding means (13) are supported by the said cam (7, 8).

15 Claims, 12 Drawing Sheets

POLE OPERATING DEVICE IN A MEDIUM-VOLTAGE ELECTRIC CONTROL APPARATUS

Figure 1:
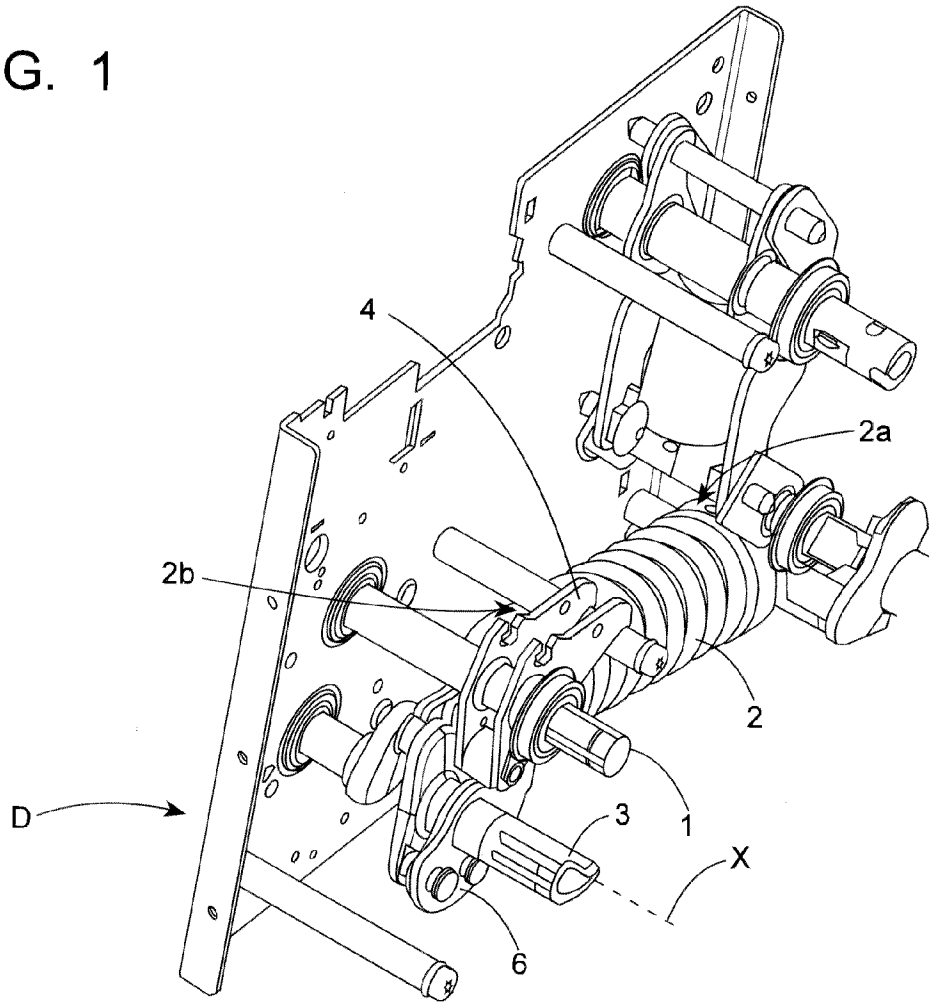

The present invention relates to a device for controlling the poles of an electric control apparatus capable of driving a shaft, called the first shaft, for supporting the movable contacts of the apparatus between an open position of the pole in which the movable contacts and the fixed contacts of the apparatus are separated and a closed position of the pole in which these movable and fixed contacts are in contact, the said device comprising a closure spring controlled by an operating shaft, called the second shaft, the said spring being capable of transmitting closure energy to the said shaft called the first shaft after compression and passing of the said spring beyond a neutral point line of passage, by means of a cam rotated by the said shaft called the second shaft, and interacting with a roller secured to the shaft called the first shaft, means for holding the control shaft called the first shaft in the closed position, and means for unlocking the aforementioned holding means allowing the rapid opening of the contacts of the apparatus.

The current control devices cannot withstand too much excess energy because of a considerable risk of breakage and of rapid fatigue of the parts of the control device due notably to the impacts then generated at the end of travel. It is therefore necessary to constantly manage and control this energy.

Devices for controlling the poles are known that comprise a closure spring capable of providing the closure energy to a cam capable of retransmitting this energy to the control shaft of the poles by means of a roller and comprising a coupling device capable of holding this control shaft of the poles in a closed position. This coupling system generates a considerable number of parts.

In this type of control, the excess energy generated during the closure is absorbed by the recompression of the spring after the closure of the pole. Consequently, this excess energy causes no impact on the parts of the control.

The present invention solves these problems and proposes a device for controlling the poles of an electric control apparatus of simple design due to the fact that it does not use a coupling system for keeping it closed, in which the excess energy is managed and which has a high speed of opening.

Accordingly, the subject of the present invention is a control device of the type mentioned above, this device being characterized in that the aforementioned holding means are supported by the said cam.

According to one particular feature, the aforementioned unlocking means are supported by the cam.

According to another feature, the aforementioned cam comprises a portion called the first portion of which at least one portion of the outer surface interacts with the roller so that the latter remains pressed on the cam after the closure thus holding the shaft called the first shaft in the closed position.

According to another feature, the aforementioned unlocking means comprise a beak-shaped portion belonging to the cam, this portion being capable of being retracted by the roller at the end of the manoeuvre for opening the apparatus corresponding to the beginning of the rotation of the control shaft called the first shaft in the opening direction, so as to make the rapid opening of this control shaft easier.

According to another feature, during a manoeuvre for opening the pole, the compression spring is compressed, and the cam is rotated so as to bring the cam and the roller to an equilibrium point, after which the portion forming a beak of the cam is retracted by the roller, which causes the contacts to open.

According to another feature, the aforementioned cam comprises a cam called a fixed cam and a cam called a movable cam, which can be rotated relative to the fixed cam, the two cams being formed in such a manner that, during a closing manoeuvre, the shaft called the second shaft drives the two cams at the same time and the roller interacts with the outer surface of the two cams, that, during an opening manoeuvre, the shaft called the second shaft is driven in the same direction, and that, at the end of the opening manoeuvre, the roller interacts only with the portion forming a beak of the movable cam so that the force component of the roller on the cam drives away the movable cam by rotation of the latter relative to the fixed cam and releases the shaft called the first shaft.

According to another feature, the fixed and movable cams comprise elongate apertures capable of interacting with posts secured to the shaft called the second shaft, so as to allow the relative rotation between the two cams between two positions delimited by the ends of the apertures and corresponding respectively to a position in which the two cams are driven at the same time and a position in which the aforementioned portion forming a beak is retracted.

According to another feature, the fixed cam and the movable cam have substantially the same shape, the movable cam having a larger dimension than the fixed cam, so that, when the two cams are driven at the same time, the two portions forming a beak are offset so that, at the end of the opening manoeuvre of the shaft called the second shaft, the roller interacts only with the beak of the movable cam.

According to another feature, the movable cam can rotate relative to the fixed cam about the rotation axis of the shaft called the second shaft, and, when the two cams are driven at the same time, the two portions forming a beak are offset angularly relative to the said axis so that, at the end of the opening manoeuvre of the shaft called the second shaft, the roller interacts only with the beak of the movable cam.

According to another feature, the cam comprises means for absorbing the excess energy generated during the closing manoeuvre of the apparatus, this energy being absorbed by recompression of the closure spring and friction of the roller on the cam.

According to another feature, these means for absorbing the excess energy comprise a portion of cam called the second portion interposed between the aforementioned first portion of the cam and the beak of the cam, this second portion having a surface interacting with the roller in order to absorb the excess energy generated during the closure by compression of the spring and friction on the roller.

According to another feature, each cam comprises a first portion in the form of a disk portion having a first radius allowing the control shaft to be held closed, followed by a second portion in the form of a disk portion having a same radius and allowing the absorption of the excess energy generated during the closure, followed by a third portion in the form of a disk portion having a radius greater than the first radius and terminated by a portion forming a beak.

According to another feature, the apparatus is a medium-voltage electrical apparatus.

According to another feature, the apparatus is a switch, the operating shaft called the first shaft being controlled manually or automatically, for example, by an energy source driving an actuator, such as for example an electric motor.

According to another feature, the cam portion called the first portion is separated from the cam portion called the second portion by a boss constituting a brake during the rotation of the cam.

According to another feature, the aforementioned device controls the contacts of a vacuum bulb.

Figure 2:
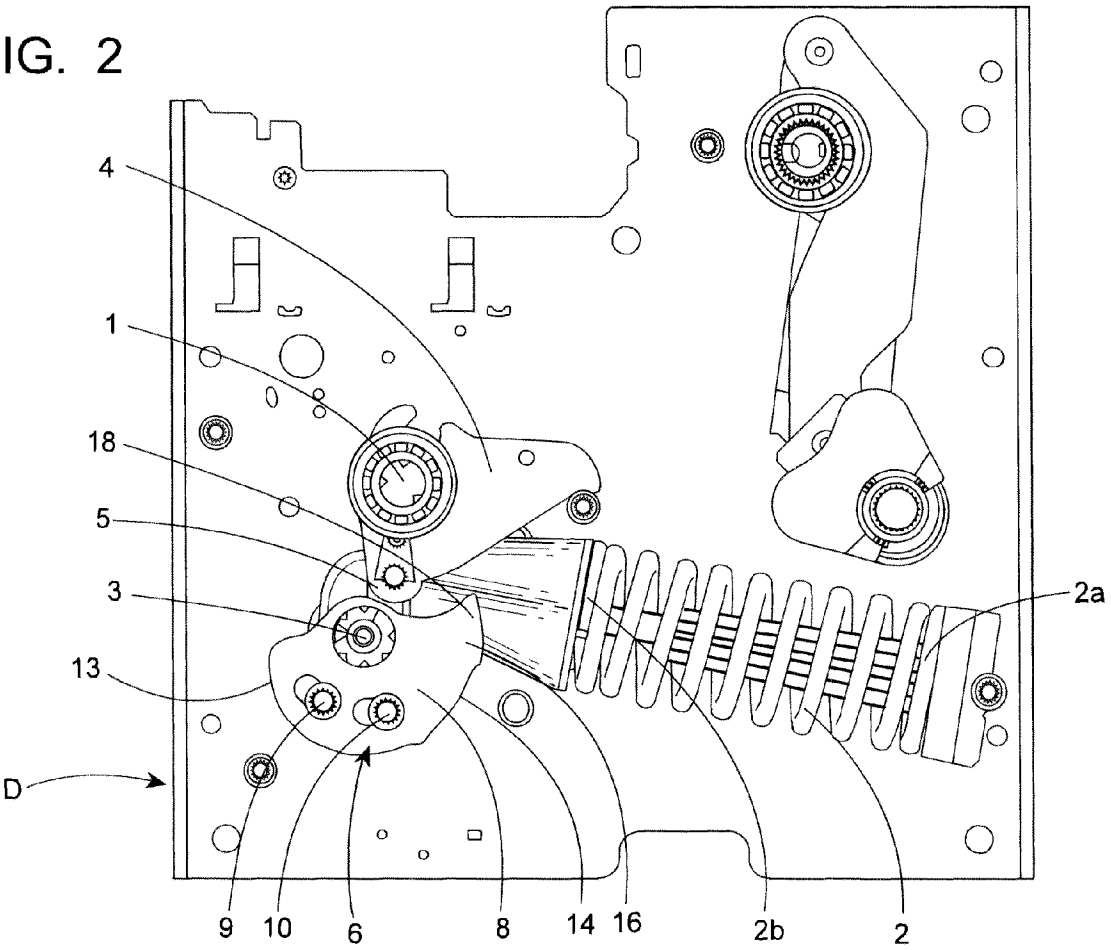
Figure 3:
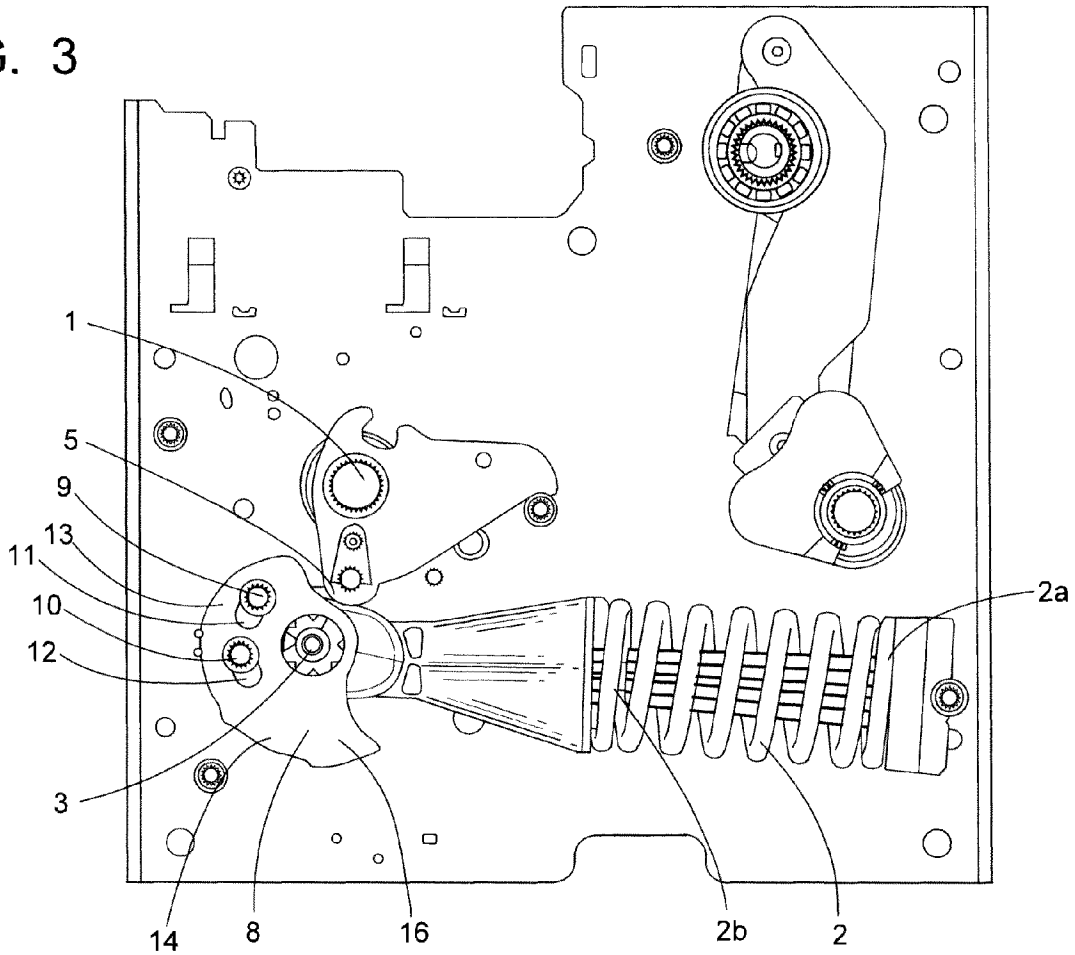
Figure 4:
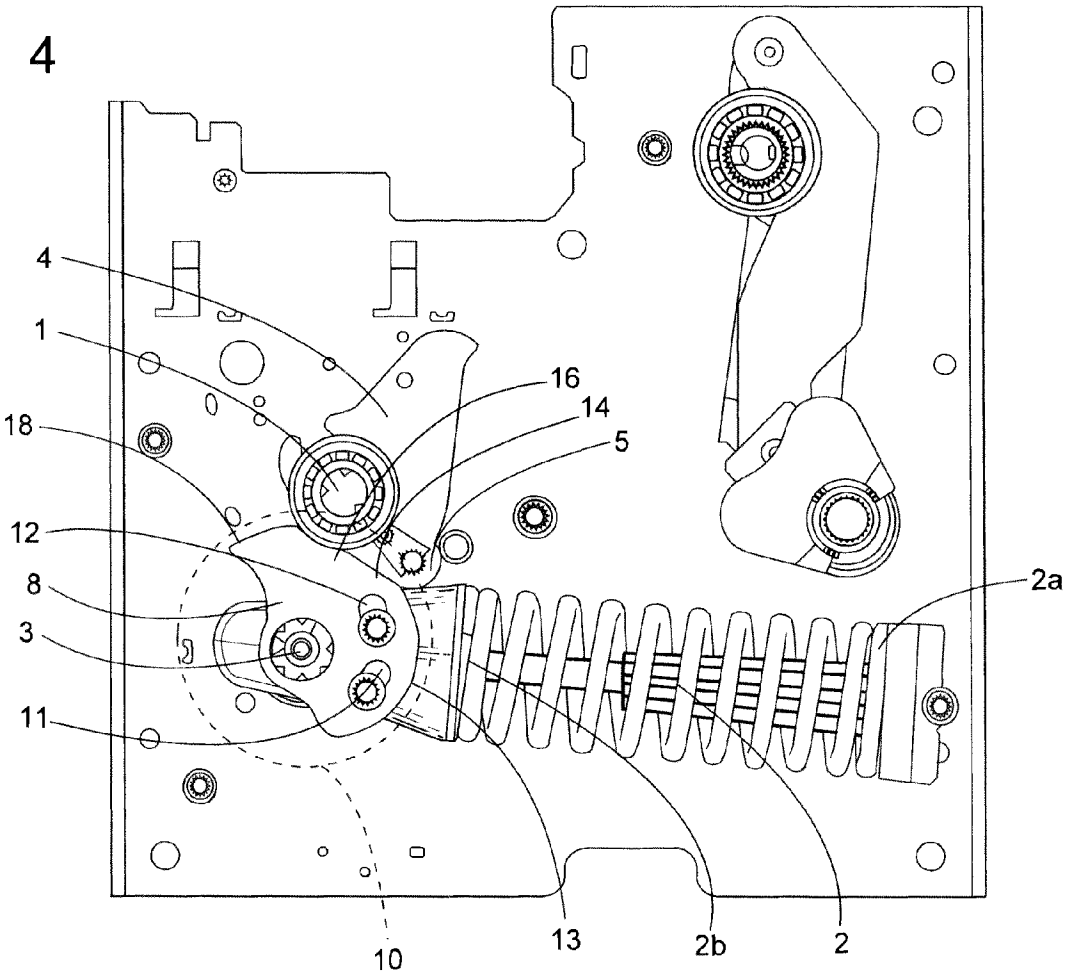
Figure 5:
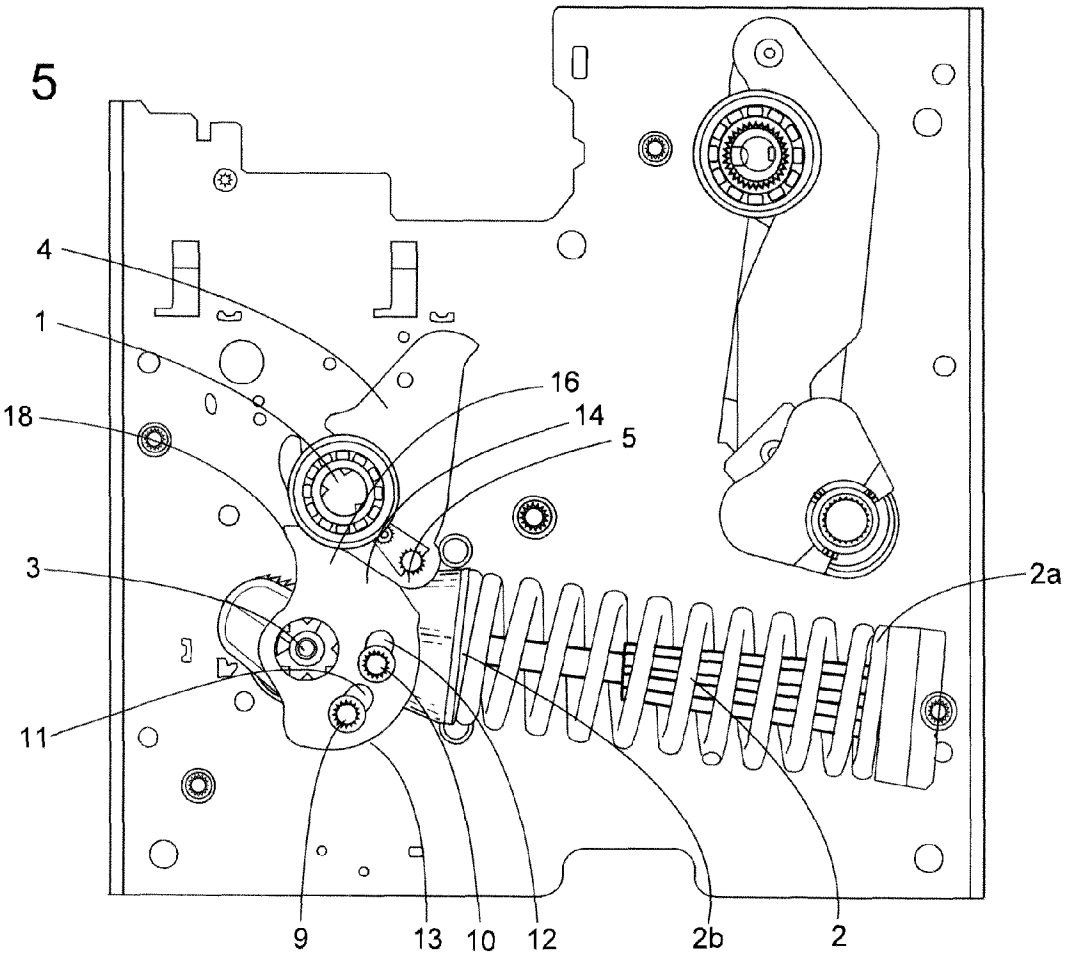
Figure 6:
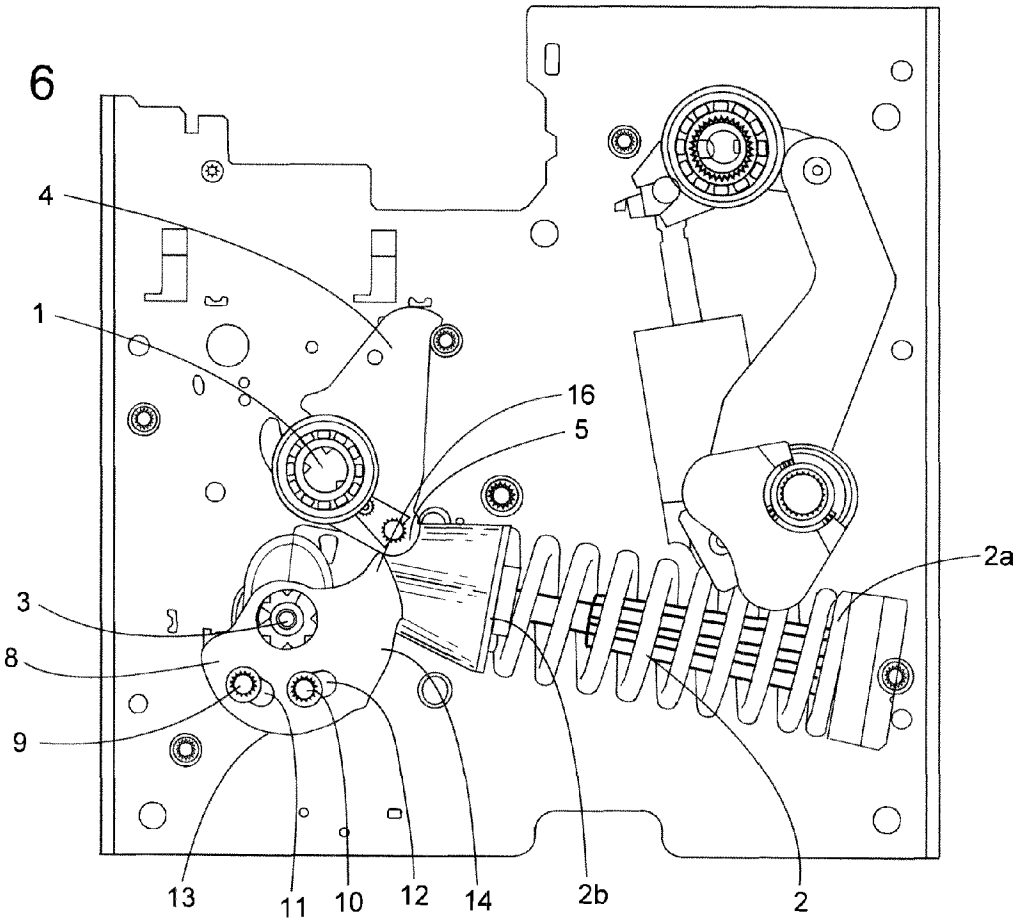
Figure 7:
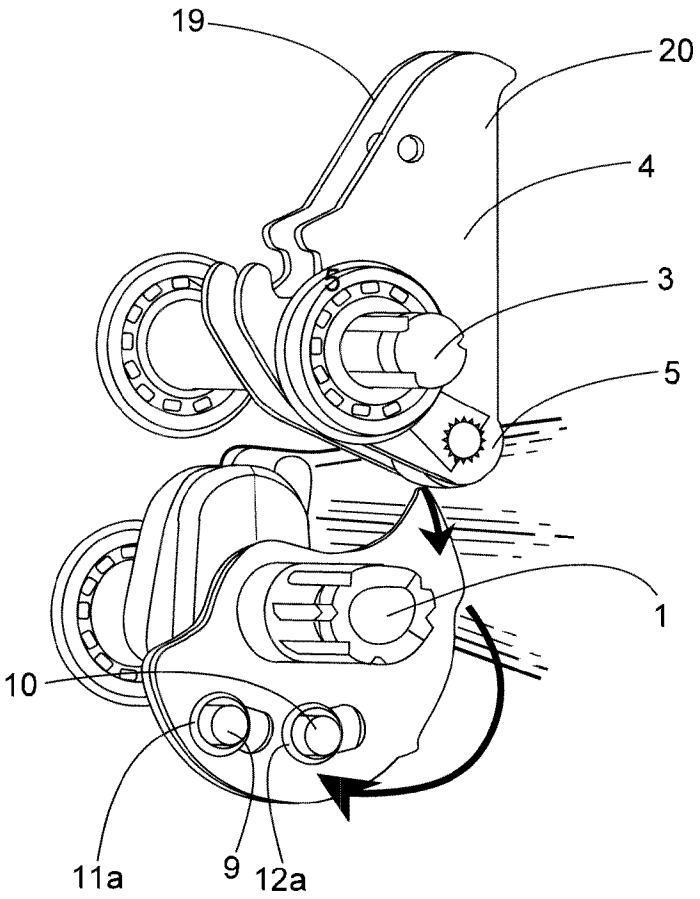
Figure 8:
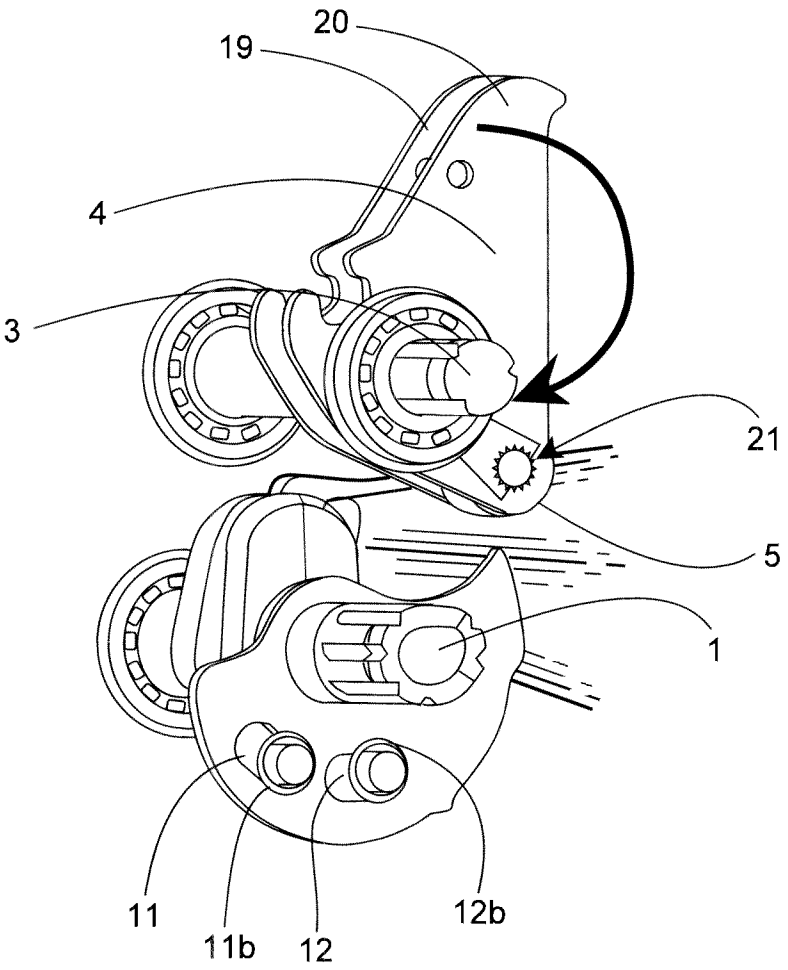
Figure 9:
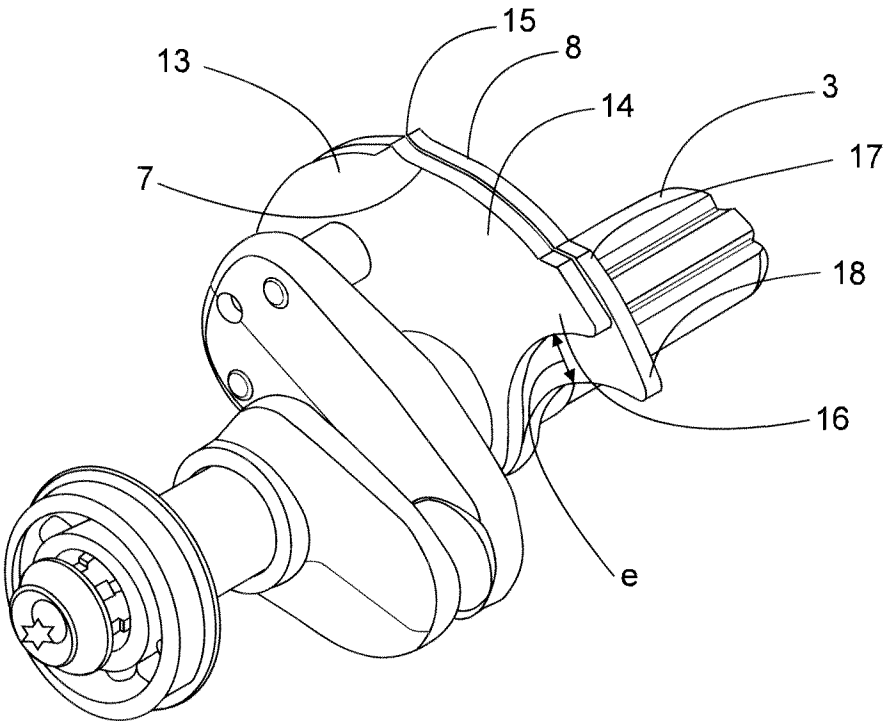
Figure 10:
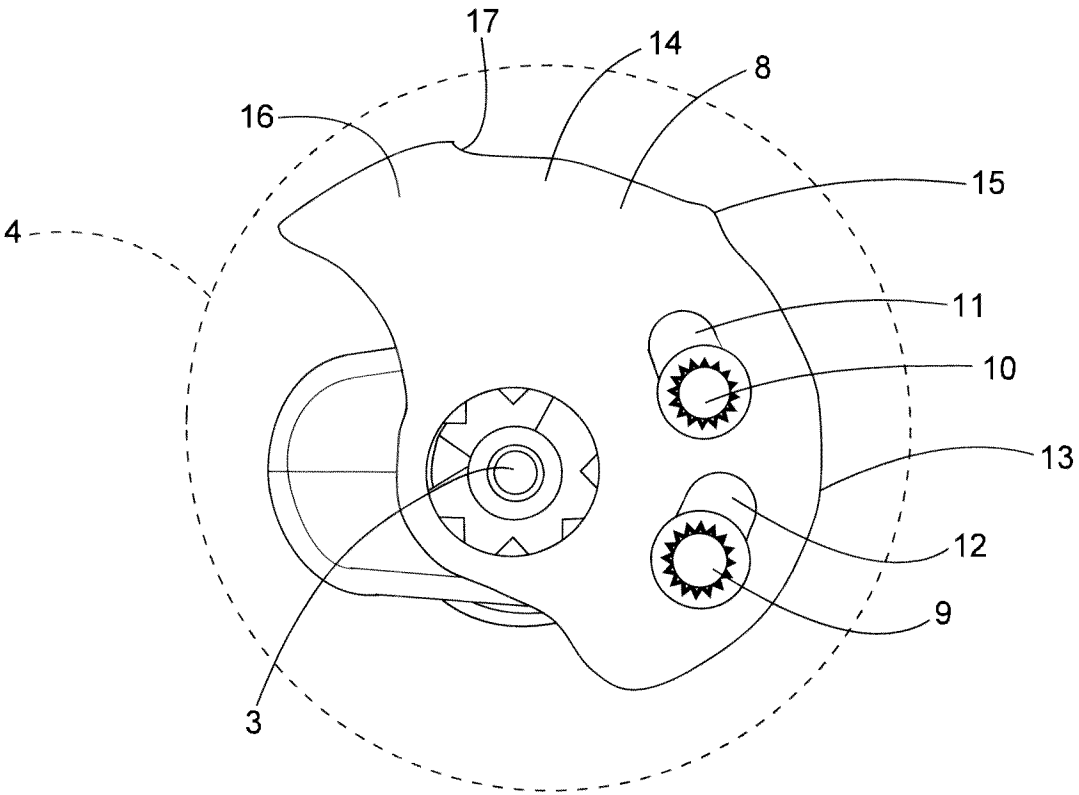
Figure 11:
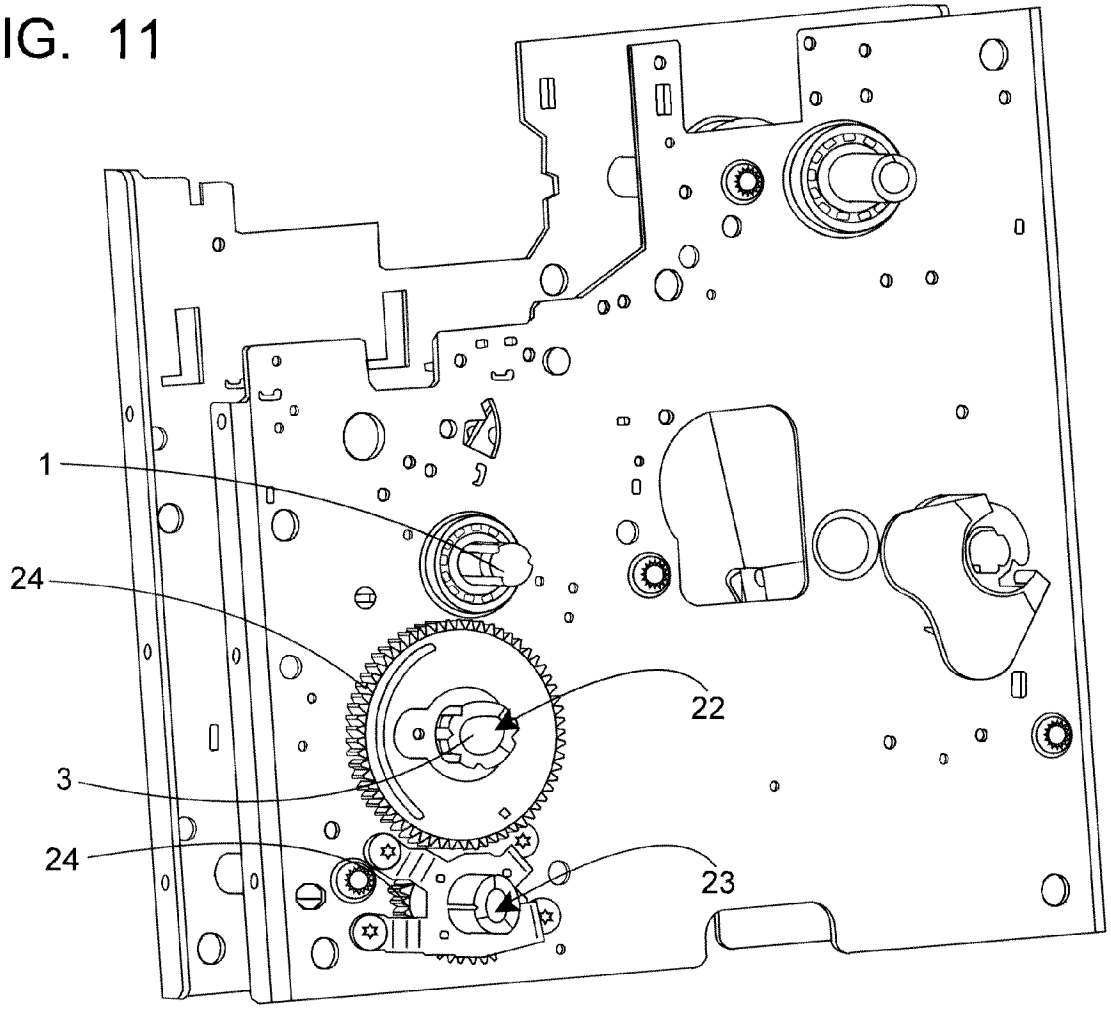
Figure 12:
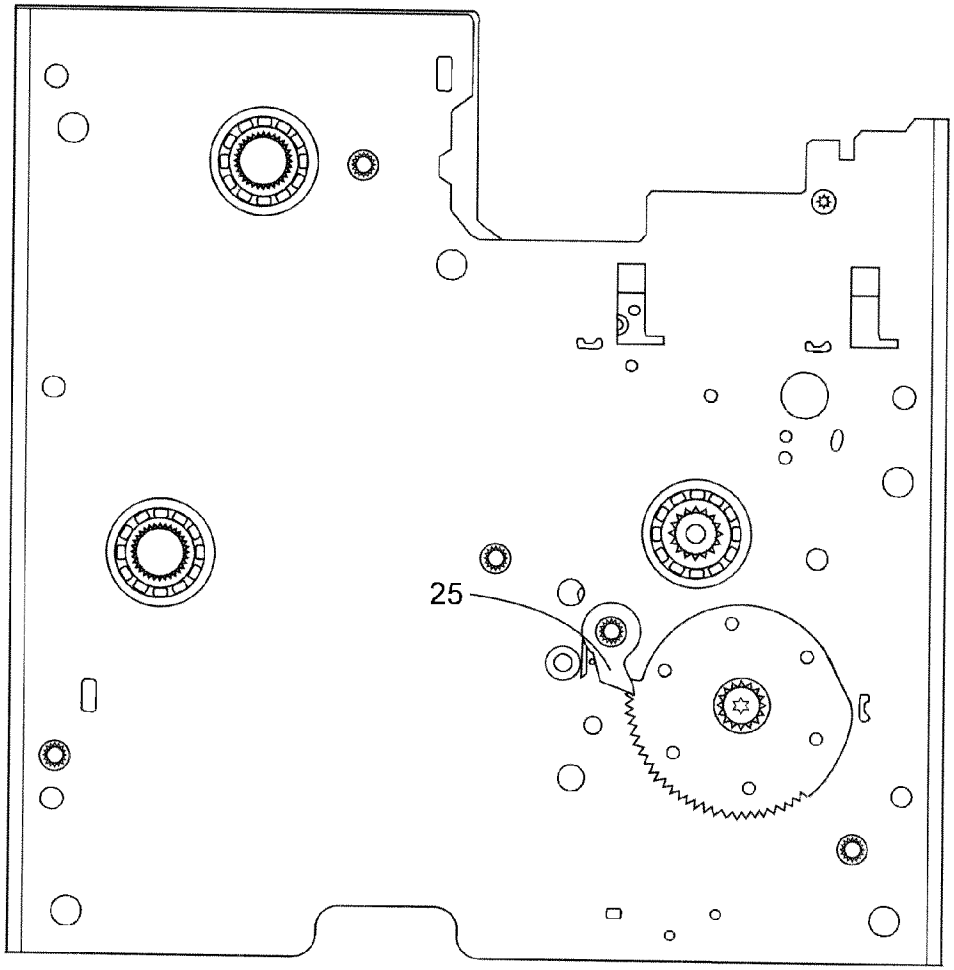

But other advantages and features of the invention will better emerge in the detailed description that follows and that refers to the appended drawings given only as an example and in which:

FIG. 1 is a partial view in perspective illustrating the control device according to the invention, FIG. 2 is a side view of the same device in the open position, FIG. 3 is a figure identical to the preceding figure, illustrating the device according to the invention at the beginning of closure, FIG. 4 is a figure identical to the preceding figure, the device being in the course of closing, FIG. 5 is a view identical to the preceding figures, the device being in the closed position, FIG. 6 is a view identical to the preceding figures, the device being in the closed position, at the beginning of the opening manoeuvre, FIGS. 7 and 8 are two partial views in perspective of a portion of the control device according to the invention, these two figures illustrating respectively two successive steps of the opening of the device, FIG. 9 is a partial view in perspective illustrating a portion of the shaft for compressing the closure spring fitted with two cams which are respectively fixed and movable according to the invention, FIG. 10 is a side view of the preceding figure illustrating more particularly the movable cam, FIG. 11 is a side view illustrating the outer face of one of the two end-pieces between which the device according to the invention is mounted, and FIG. 12 is a side view illustrating the outer face of the other of the two end-pieces.

FIGS. 1 to 6 show a control device D for controlling the poles of a medium-voltage electric control apparatus according to the invention, such as a medium-voltage electric switch, this control device being designed to control the contacts (not shown) of a vacuum bulb A.

This device comprises, for each pole of the apparatus, a shaft for controlling the poles called the first shaft 1, that can rotate between an open position and a closed position of the contacts of the apparatus. This device also comprises a spring called a closure spring 2 controlled by a shaft called the second shaft 3 forming a crankshaft, that can be operated by a user from the outside of the apparatus in order to manually open or close the apparatus by operating the control shaft called the first shaft 1.

This shaft called the first shaft comprises a handle 4 comprising a roller 5 capable of interacting with a cam system 6 controlled by the aforementioned spring 2 as will be explained hereinafter.

This spring 2 is resting by one of its ends 2*a* on a fixed point of the frame of the apparatus, and, by its opposite end 2*b*, is mechanically connected to this cam system so that the operation of the shaft for compressing the spring, called the second shaft, in the closure direction, rotates the cam system 6 and compresses the spring until the spring passes beyond a neutral point line of passage, after which the spring takes over for driving the cams 7, 8, which then interact with the roller 5 in order to drive the shaft called the first shaft to a position of closure of the contacts. The opening of the contacts is carried out by operating the control shaft called the second shaft in the same direction.

This cam system 6 is mounted so as to rotate about an axis X corresponding to that of the shaft called the second shaft 3 for operating the spring 2 and comprises, as illustrated in FIGS. 7 to 10, a fixed cam 7 secured to the shaft called the second shaft, and a cam called the mobile cam 8 mounted so as to rotate about this axis X relative to the fixed cam 7 between two positions by virtue of two posts 9, 10 secured to this shaft called the second shaft interacting respectively with two apertures 11, 12 provided in this cam called the movable cam, the rotary travel of this movable cam being defined by the shape and the dimensions of the apertures and the position of the posts on the shaft called the second shaft.

These two cams 7, 8 are mounted on the shaft called the second shaft 3, so as to be superposed on one another, these two cams having one and the same profile, the movable cam being larger than the fixed cam so as to project beyond the latter when they are superposed. Each of these cams is formed of three successive disk portions, namely a first and a second disk portion 13, 14 with the same radius separated by a protuberance 15, then a last portion 16 separated from the second portion 14 by a protuberance 17 having a radius greater than that of the aforementioned last two portions 13, 14 and terminating in a beak 18.

Advantageously, the first and the second cam portion have substantially one and the same constant radius so as not to further compress the opening and contact-pressure spring.

As is more particularly illustrated in FIGS. 1, 6 and 7, the aforementioned handle 4 consists of two end-pieces 19, 20 that are parallel with one another, connected by a spindle 21 supporting the aforementioned roller 5, this roller 5 being designed to interact with the aforementioned cams 7, 8.

The operation of the control device according to the invention will be described hereinafter with reference to the figures:

In FIG. 2, the apparatus is in the open position at the very beginning of a closure manoeuvre, in which position the compression spring 2 is in the partially compressed position, the roller 5 not interfering with the outer surface of the cams. During a manual closing manoeuvre, the user rotates the shaft 3 for compressing the spring called the second shaft in the clockwise direction. This rotation rotates the two cams 7, 8 in this same direction. At the beginning of this rotation, the movable cam 8 passes beyond the fixed cam 7 on both sides of the latter, this being due to the fact that it has been driven away by the roller 5 during the opening that has preceded. And during the rotation of the shaft 3, the aforementioned posts 9, 10 move towards the first end 11*a*, 12*a* of the apertures 11, 12 and are capable of rotating the movable cam 8. When the posts are at this end, the movable cam moves beyond the fixed cam only at one of the ends of the two cams, the end forming a beak 18, while at the opposite end, the two cams are superposed.

During a first rotary movement of the shaft 3, the spring 2 is compressed and the cams 7, 8 are rotated in the clockwise direction along a first travel during which the roller 5 and the cams 7, 8 do not yet interfere (FIG. 2). Then, during the continuation of the rotation of the shaft called the second shaft 3, the spring 2 reaches a neutral point passage position illustrated in FIG. 3, then passing to a decompression phase during which the spring takes over for driving the cams 7, 8, the latter soon afterwards coming into contact with the roller 5 and rotating the roller and therefore also the shaft 1 for controlling the poles, in the anticlockwise direction by means of the handle 4, until the contacts of the apparatus close. Thus, the shaft called the second shaft 3 supplies the closure energy to a cam system 6 which retransmits this energy to the shaft called the first shaft 1 by means of a roller 5. From the moment when the roller is in contact with the cam and throughout the closing manoeuvre, this roller 5 remains pressed on the surface of the cams as illustrated in FIG. 4. The first portion 13 of the cam makes it possible to keep the control shaft 1 closed while the second portion 14 is used to absorb the excess energy of the control, by recompression of the closure spring 2 and friction of the roller 5 on the cams 7, 8. The profile of the cams is such that the roller remains pressing on the cams even with a very high excess energy, as illustrated in FIG. 5.

During an opening manoeuvre, this time illustrated in FIG. 6, the shaft called the second shaft is rotated in the clockwise direction, that is to say in the same direction as for the closure, which has the effect of compressing the spring 2, this spring already having been partly compressed during the closure during the absorption of the excess energy.

In order to dissociate the closing manoeuvre and the opening manoeuvre as illustrated in FIGS. 10 and 11, a second manoeuvring orifice 23 mechanically connected to the first 22 by a gearwheel system 24 is used. This makes it possible to reverse the manoeuvring direction, the manoeuvring shaft 3 still being driven in the same direction.

By recompressing the spring 2, the operator causes the shaft 3 supporting the cams 7, 8 and thus the cams to turn in the clockwise direction, the two cams turning at the same time due to the fact that the posts 9, 10 are at the end called the first end 11*a*, 12*a* of the apertures 11, 12. During this rotation as illustrated in FIGS. 7 and 8, the roller 5 rolls on the two cams 7, 8, then, at the end of this rotation corresponding substantially to the halfway compression travel of the spring 2, the roller 5 rolls on only one of the cams, the movable cam, because of the difference in size between the two cams generating a distance e between the end portions of these two cams.

At the end of the rotational travel of the manoeuvring shaft, the force component applied by the roller 5 on the movable cam 8, illustrated by the arrow in FIG. 7, drives away the movable cam, which turns relative to the fixed cam in the clockwise direction until the posts 9, 10 reach the ends of the apertures 11*b*, 12*b* opposite to the foregoing, thus releasing the control shaft 1, called the first shaft, controlling the poles, which can be brought into the open position of the contacts by means of an opening spring (not shown) provided for this purpose to rapidly open the contacts.

The movable cam therefore allows the rapid opening of the apparatus through its retraction, and therefore removes any force component of the shaft supporting the cams on the roller.

Thus, by recompressing the spring, during an opening manoeuvre, the shaft 3 supporting the cams 7, 8 is rotated and the roller 5 and the movable cam 8 brought to an equilibrium point, after which equilibrium point, the movable cam 8 is driven away by the roller and the opening instruction is given. In this step, the decompression of the spring is prevented by ratchets.

Therefore, after passing the equilibrium point, the movable cam 8 escapes under the effect of the roller 5 and does not brake the rotation of the latter. There is therefore no need to continue compressing the spring 2 at the beginning of the rotation of the control shaft called the first shaft, as this would be the case in order to cause the cams to turn a little more for the purpose of releasing the roller, if the movable cam were not present, and only one fixed cam were used. Continuing to compress the closure spring would cause a loss of opening speed. This movable cam therefore allows the control shaft of the poles, called the first shaft, to be totally free, at the beginning of opening, as during the release of a coupling.

Note also the presence of a non-return ratchet 25 interacting with the aforementioned gearwheel so as to prevent the reverse rotation of the shaft controlling the compression of the spring.

This principle therefore rests on a rotation in only one direction and a shaft called the secondary shaft that is able to be held in position.

By virtue of the invention, a control device is thus produced making it possible to keep the pole in the closed position, by the closure cam which provides the closure energy on the roller of the shaft for manoeuvring the poles.

This control device makes it possible to open the pole by causing the shaft that supplies the closure energy to turn, by recompressing its spring, which makes it possible to store a portion of the closure energy in its spring for a subsequent manoeuvre.

A second cam has been created that has a degree of freedom relative to the first, so as not to brake the opening of the shaft for controlling the poles, which otherwise would risk butting against the latter by means of the roller.

Also noted will be an increase in the opening speed due to the fact that the radius of the cam is greater, just before the opening instruction is given.

By virtue of the invention, therefore, a device is produced for controlling the poles of an electric switching apparatus of simple design due to the fact that this device comprises no coupling device for keeping the shaft for controlling the poles in the closed position. The excess energy generated during the closing is managed by the recompression of the closure spring and the outer surface of the cam interacting with the roller. The profile of the cam makes it possible to absorb the excess energy without opening the apparatus.

It will be noted that the shape of the cam is not limited to that as the disk portion illustrated, but may take any shape comprising a hemispherical portion allowing the juxtaposition of the two cams, the holding in the closed position of the control shaft by a first cam portion and the absorption of the excess energy by a second portion of the cam and a portion comprising means allowing the retraction of the movable cam by the roller.

This device also has great opening speed due to the fact that the shaft for controlling the poles can be released rapidly, as during a coupling, at the beginning of the rotation of the control shaft for carrying out the opening by virtue of the retraction of the movable cam removing all risk of impacts and energy absorption.

The invention can be applied to any type of control and/or protective electric apparatus comprising a contact-control device.

Naturally, the invention is not limited to the embodiment described and illustrated which has been given only as an example.

On the contrary, the invention comprises all the technical equivalents of the means described and their combinations if the latter are carried out in its spirit.

The invention claimed is:

1. A device for controlling the poles of an electric control apparatus, said device comprising:

a first shaft causing movable contacts of such an apparatus to move between an open position of the poles wherein movable contacts and fixed contacts of such an apparatus are separated, and a closed position of the poles wherein such movable and fixed contacts will be in contact, a closure spring, a second shaft, one end of said closure spring engaging a can mounted on said second shaft for transmitting closure energy to said first shaft after compression of said spring and passing beyond a neutral point of the cam rotated by the said second shaft, a roller secured to the first shaft and contacting said cam, means for holding the first shaft in the closed position, and means for unlocking the holding means thereby permitting rapid opening of contacts of such an electric control apparatus, wherein both the holding means and the unlocking means are supported by said cam.

2. The device for controlling the poles according to claim 1, wherein the radially outer surface of the cam comprises a first portion which interacts with the roller which remains pressed on the cam after closure thus holding the first shaft in the closed position.

3. The device for controlling the poles according to claim 1, wherein the unlocking means comprise a beak-shaped portion of the cam, which portion is retracted by the roller at the end of opening the apparatus at the beginning of rotation of the first shaft in an opening direction, for easier rapid opening by the first shaft.

4. The device for controlling the poles according to claim 3, wherein when opening the pole, the compression spring is compressed, and the cam is rotated to bring the cam and the roller to an equilibrium point, after which the beak-shaped portion of the cam is retracted by the roller causing the contacts to open.

5. The device for controlling the poles according to claim 4, wherein the cam comprises two cams, a fixed cam, and a movable cam which can be rotated relative to the fixed cam, the fixed and movable cams being coaxially mounted on the second shaft which drives said two cams at the same time, and the roller interacts with the outer surface of said two cams, during opening, the second shaft being driven in the same direction, and at the end of opening, the roller interacts only with the beak-shaped portion of the movable cam so that a force component of the roller on the cam drives away the movable cam by rotation relative to the fixed cam and releases the first shaft.

6. The device for controlling the poles according to claim 5, wherein the fixed cam and movable cam comprise elongate apertures capable of interacting with posts secured to the second shaft, to allow relative rotation between the two cams between two positions delimited by the ends of the apertures and corresponding, respectively, to a position in which the two cams are driven at the same time and a position in which the beak-shaped portion is retracted.

7. The device for controlling the poles according to claim 5, wherein the fixed cam and the movable cam have substantially the same shape, the movable cam having a larger dimension than the fixed cam, so that, when the two cams are driven at the same time, beak-shaped portions of said two cams are offset so that at the end of opening by the second shaft, the roller interacts only with the beak-shaped portion of the movable cam.

8. The device for controlling the poles according to claim 7, wherein the movable cam can rotate relative to the fixed cam about the rotation axis X of the second shaft, so that when the two cams are driven at the same time, the beak-shaped portions are offset angularly relative to said axis X so that, at the end of opening the roller interacts only with the beak-shaped portion of the movable cam.

9. The device for controlling the poles according to claim 1, wherein the cam comprises means for absorbing the excess energy generated during closing, said energy being absorbed by recompression of the closure spring and friction of the roller on the cam.

10. The device for controlling the poles according to claim 2, wherein said cam comprises a second portion between the first portion of the cam and the beak-shaped portion of the cam, said second portion having a surface interacting with the roller to absorb excess energy generated during the closure by compression of the spring and friction on the roller.

11. The device for controlling the poles according to claim 5, wherein each cam comprises a first portion in the form of a disk portion having a first radius whereby the first shaft can be held in closed position, followed by a second disk portion having the same radius as for absorption of excess energy generated during closure, followed by a third disk portion having a third radius greater than the first radius and terminated by a beak-shaped portion.

12. The device for controlling the poles according to claim 1, wherein the apparatus is a medium-voltage electric apparatus.

13. The device for controlling the poles according to claim 1, wherein the apparatus is a switch, and the first shaft is controlled manually or automatically.

14. The device for controlling the poles according to claim 10, wherein the first cam portion is separated from the second cam portion by a boss for braking rotation of the cam.

15. The device for controlling the poles according to claim 1, wherein the control device controls the contacts of a vacuum bulb.

* * * * *